US005156345A

United States Patent [19]

Baker

[11] Patent Number: 5,156,345

[45] Date of Patent: Oct. 20, 1992

[54] FAN-TYPE YARD WASTE PROCESSING APPARATUS

[75] Inventor: Herbert R. Baker, Milwaukee, Wis.

[73] Assignee: Tornado Products, Inc., Germantown, Wis.

[21] Appl. No.: 736,718

[22] Filed: Jul. 26, 1991

[51] Int. Cl.[5] ..... B02C 13/10

[52] U.S. Cl. ..... 241/56; 241/101.7; 241/190

[58] Field of Search ..... 241/56, 190, 189 R, 241/101.7

[56] References Cited

U.S. PATENT DOCUMENTS

| | | | |
|---|---|---|---|
| 3,240,247 | 3/1966 | Lautzenheiser | 241/190 |
| 3,712,353 | 1/1973 | Ferry | 241/27 |
| 3,817,462 | 6/1974 | Hamlin | 241/101.7 |
| 4,824,034 | 4/1989 | Baker | 241/101.2 |
| 4,875,630 | 10/1989 | Carlson | 241/56 |
| 4,951,882 | 8/1990 | Ober | 241/55 |
| 5,018,672 | 5/1991 | Peck et al. | 241/37.5 |
| 5,085,376 | 2/1992 | Litchenburg | 241/56 |

*Primary Examiner*—P. W. Echols
*Assistant Examiner*—John M. Husar
*Attorney, Agent, or Firm*—Andrus, Sceales, Starke & Sawall

[57] ABSTRACT

An apparatus for processing yard waste material such as branches, leaves, twigs or the like includes a hopper, a grinding mechanism disposed within a grinding chamber in communication with the hopper, and a fan mechanism disposed within a fan chamber in communication with the grinding chamber. The fan mechanism includes a plurality of fan blades which generate negative air pressure upon rotation of the fan mechanism, and the negative air pressure is communicated through the grinder housing to the hopper. Material is drawn from the hopper into the grinding chamber by the negative air pressure, where the material is ground and then drawn into the fan chamber. A discharge passage is formed in the fan chamber, to convey the ground material to a discharge outlet associate with the fan chamber. A hose assembly can be employed as an alternative to the hopper for supplying the material to the grinding chamber. A chipper assembly, consisting of one or more chipper knives is mounted to the fan mechanism and rotatable therewith, and a chipper opening is formed in a wall of the fan housing to allow branches or the like to be chipped.

28 Claims, 3 Drawing Sheets

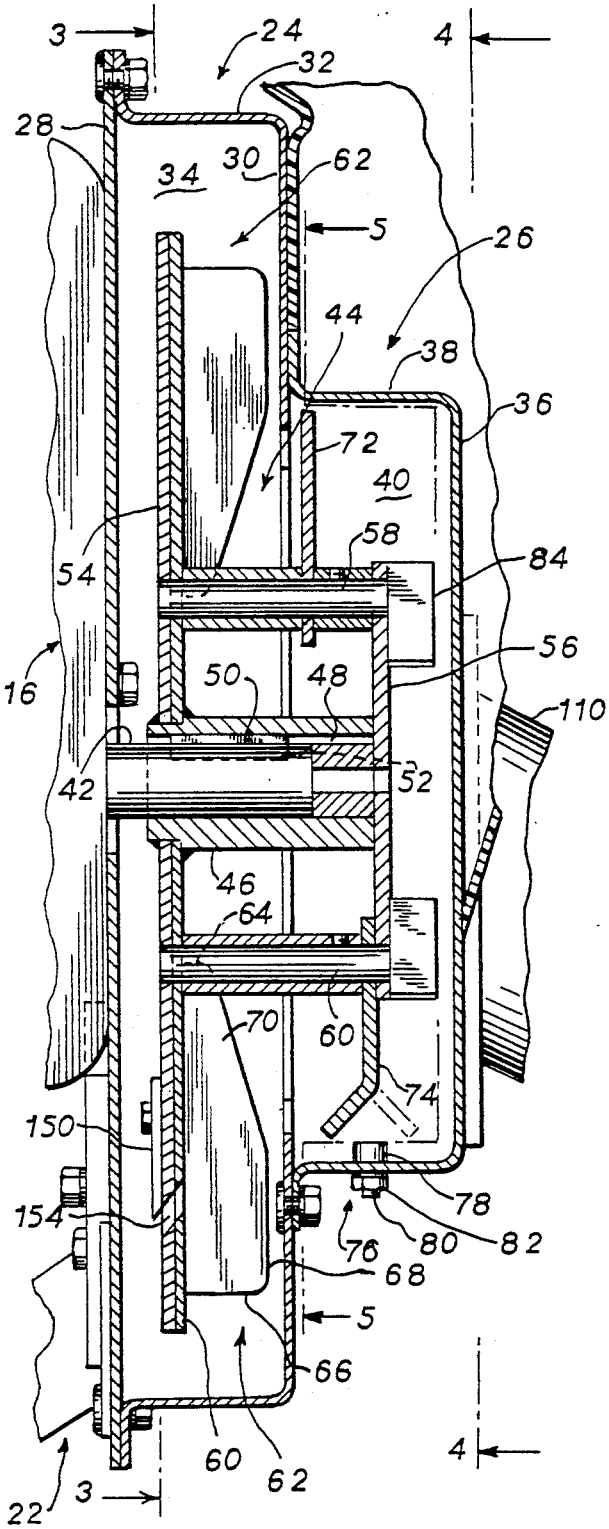
FIG. 2
FIG. 6
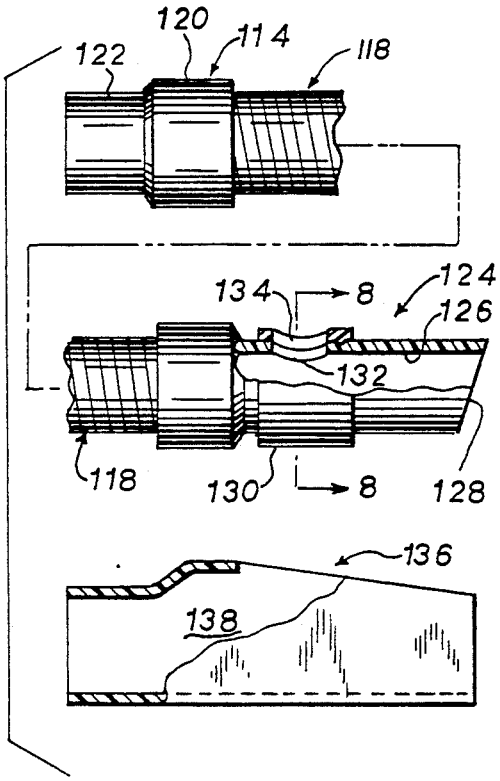
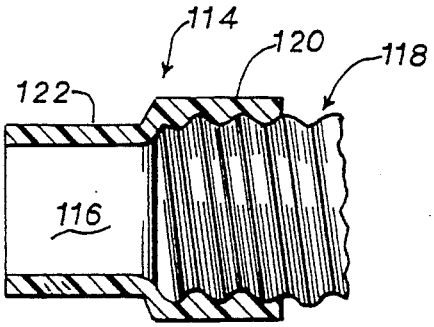
FIG. 7
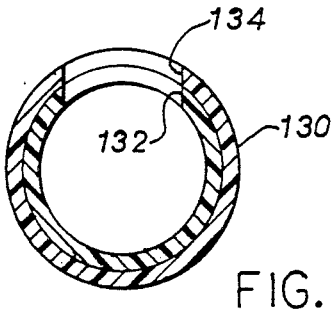
FIG. 8

FAN-TYPE YARD WASTE PROCESSING APPARATUS

BACKGROUND AND SUMMARY

This invention relates to an apparatus for grinding materials such as branches, leaves, twigs or the like to reduce the size of the material, and to thereafter discharge the ground material.

With increasing environmental concerns and landfill problems, many municipalities strictly limited the manner in which yard waste such as branches, leaves, twigs or the like can be disposed. It is not uncommon for a municipality to altogether ban the presence of such material in conventional refuse pick-up, and to require that such material be disposed of in accordance with strictly enforced regulations.

Accordingly, it has become necessary for a homeowner to take a more active role in disposal of yard waste material. Many homeowners comply with local regulations pertaining to disposal of yard waste material by placing such material in a separate receptacle for pick-up, or by carrying such material to an approved site for disposal.

In view of the above, there exists a need for a device which a homeowner can employ to assist in disposal of yard waste material. While conventional chipper/shredders are often owned and used by serious gardeners and/or homeowners with larger properties, such machines are generally fairly expensive and have a much greater capacity than is needed by most homeowners.

It is an object of the present invention to provide an apparatus for processing yard waste material such as branches, leaves, twigs or the like, which is relatively less expensive to produce than a conventional chipper/shredder, and which accordingly can be afforded by a greater number of homeowners. It is another object of the invention to provide an apparatus for processing yard waste material which is light in weight and compact in shape, which therefore is easy to use and store. It is a further object of the invention to provide such an apparatus which is relatively simple in its construction and operation, yet which provides highly efficient grinding of yard waste material to effectively reduce its size prior to disposal or use of the ground material as mulch.

In accordance with one aspect of the invention, an apparatus for processing yard waste material comprises a grinder housing which defines a grinding chamber having an inlet through which unprocessed material is introduced into the grinding chamber. The apparatus further includes a fan housing defining a fan chamber located adjacent the grinder housing, with the fan chamber including an outlet through which processed material is discharged. The grinding chamber and the fan chamber are in communication with each other. A rotatable grinding mechanism is located within the grinding chamber, to grind material introduced into the grinding chamber upon rotation of the grinding mechanism. A rotatable fan mechanism is located within the fan chamber. Rotation of the fan mechanism generates negative air pressure within the fan chamber to draw ground material from the grinding chamber into the fan chamber. The rotatable fan mechanism and the fan chamber cooperate to define an arcuate discharge flow path to which ground material is supplied from the grinding chamber. At least a portion of the discharge flow path experiences positive air pressure during rotation of the fan mechanism, to move the ground material toward the fan chamber discharge outlet. The grinding mechanism and the fan mechanism are preferably connected together and rotatable with each other, and are rotatably driven in response to rotation of a rotatable output shaft associated with a rotary power source, such as a conventional gasoline or electric engine. The fan mechanism and the grinding mechanism are mounted side-by-side on a rotor assembly rotatable about a rotor axis, with a portion of the rotor assembly being located within the fan chamber and a portion located within the grinding chamber. The rotor assembly consists of a pair of spaced plates interconnected through a series of shafts, with one of the plates being located in the fan chamber and the other of the plates being located in the grinding chamber. The fan mechanism includes a series of fan blades, which are interconnected with one of the plates. The grinding mechanism includes a series of hammers pivotably mounted to the shafts which extend between the pair of plates. The hammers are located adjacent an arcuate inner wall defined by the grinder housing, and one or more projections are provided on the grinder housing inner wall for engaging the material to facilitate grinding of the material by the hammers. The fan chamber and the grinding chamber are separated by a wall, with an opening being formed in the wall to allow passage of ground material from the grinding chamber into the fan chamber. A series of spaced scallops are provided in the opening for providing passage of ground material into the fan chamber. The ground material is drawn through the scallops into the fan chamber by the negative air pressure generated by rotation of the fan mechanism, after the particles of material are ground to a sufficiently reduced size or weight to allow the particles to pass through the scallops. A hopper structure is connected to the grinder housing, and defines a passage through which unprocessed material is supplied to the grinder housing inlet. In a preferred form, a second inlet is formed in the grinder housing, and a vacuum hose is connectable through a connector assembly with the grinder housing. Various attachments can be secured to the outer end of the vacuum hose, such as a leaf tray into which leaves can be raked, or a nozzle to allow leaves or other debris to be sucked from areas which are difficult to reach with a rake. The apparatus further includes a chipper assembly, consisting of one or more chipper knives mounted to a chipper plate, to which the fan blades are secured. The fan housing is provided with a chipper opening over which the chipper knives pass upon rotation of the fan mechanism, and branches can be passed through the chipper opening for chipping by the chipper knives. The branch chips are then conveyed through the fan housing by the positive air pressure generated by rotation of the fan mechanism, to the fan housing discharge outlet. The arcuate discharge flow path defined by the fan mechanism and the fan chamber comprises a scroll having an increasing transverse dimension in the direction of rotation of the fan mechanism, toward the fan housing discharge outlet. This arrangement provides highly satisfactory conveying of ground or chipped material within the fan chamber toward the fan chamber discharge outlet.

In accordance with another aspect of the invention, the hopper defines a cavity, which communicates through a substantially vertical passage with the inlet to the grinder housing. A guard member is located within the hopper cavity in vertical overlapping relationship with the passage through which the hopper cavity communicates with the grinder housing inlet. The hopper is constructed so as to define a flow path for the unprocessed material, around the guard member and leading to the passage. With this arrangement, the passage is blocked in a vertical direction, so as to prevent kickback of the material upwardly out of the hopper cavity from the passage. The hopper preferably includes a curved wall defining a portion of the hopper cavity, with the curved wall being spaced from an material along the curved wall during operation.

In accordance with yet another aspect of the invention, the grinder housing and the fan housing comprise an assembly which defines a pair of spaced vertical mounting surfaces, with the grinding mechanism and the fan mechanism being rotatable about a substantially horizontal axis of rotation and being driven by a power source having a horizontal output shaft. The hopper is mounted to one of the spaced vertical mounting surfaces, and the power source is mounted to the other of the vertical surfaces. This arrangement provides a compact overall package for the yard waste material processing apparatus. A chipper assembly is provided, and includes a chipper knife which passes over a chipper opening formed in one of the vertical mounting surfaces. A chipper chute is mounted to the same vertical mounting surface, and defines an internal passage communicating with the chipper opening.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is a partial vertical section view through the fan housing and grinder housing of the apparatus of FIG. 1;

FIG. 6 is a schematic representation of the vacuum hose connectable to the grinder housing;

FIG. 7 is a partial section view showing connection of the vacuum hose to an adaptor engageable with a connector assembly mounted to the grinder housing; and FIG. 8 is a section view taken along line 8—8 of FIG. 6.

DETAILED DESCRIPTION OF THE INVENTION

Figure 1:
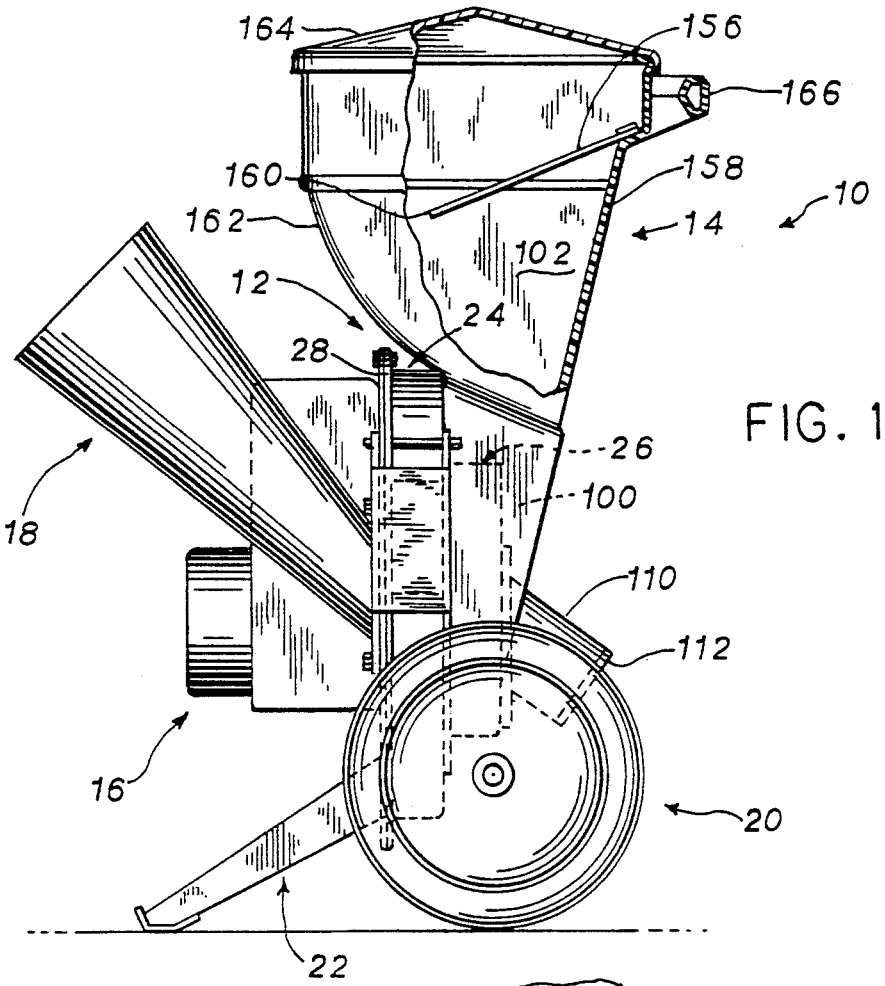
FIG. 1 is a side elevation view, with portions broken away, showing the yard waste material processing apparatus of the invention.

Referring to FIG. 1, a yard waste material processing apparatus 10 consists generally of a housing assembly 12, a hopper 14, an engine 16, a chipper chute 18, a pair of wheels such as shown at 20, and a leg 22.

Engine 16 may be any satisfactory electric or gasoline powered internal combustion engine, providing rotary output power through a horizontal output shaft.

Housing assembly 12 consists of a fan housing, shown generally at 24, and a grinder housing, shown generally at 26. Fan housing 24 is connected to an engine plate 28, and engine 16 is mounted to engine plate 28. In addition, chipper chute 18 is mounted to engine plate 28, as is leg 22.

Referring to FIG. 2, fan housing 24 includes a vertical wall 30 spaced from and parallel to engine plate 28, and an arcuate horizontal wall 32 formed integrally with vertical wall 30 and defining a flanged portion secured to engine plate 28 such as through bolts or the like. A fan chamber 34 is defined in the interior of fan housing 24 by engine plate 28, vertical wall 30, and arcuate horizontal or lateral wall 32.

Grinder housing 26 consists of a vertical outer wall 36 spaced from and parallel to vertical outer wall 30 of fan chamber 24, and a circular horizontal or lateral wall 38. Horizontal wall 38 includes a vertically flanged portion which is secured to fan housing vertical wall 30 through bolts or the like. Grinder housing walls 36 and 38, in combination with fan chamber vertical wall 30, define a grinding chamber 40.

As shown in FIG. 2, the horizontal rotatable output shaft of engine 16 is shown at 42, extending inwardly through fan chamber 34 and into grinding chamber 40. A rotor assembly, shown generally at 44, is mounted to engine output shaft 42. Rotor assembly 44 includes a central hub 46 which defines an internal cylindrical passage adapted to receive engine output shaft 42. A keyway 48 is provided in the internal passage of hub 46, and a key 50 is engaged within keyway 48 and a keyway 52 provided in engine output shaft 42, to non-rotatably mount rotor assembly 44 to engine output shaft 42.

Rotor assembly 44 further includes a disc-like chipper plate 54 located within fan chamber 34, and a grinder hub plate 56 located within grinding chamber 40. Chipper plate 54 and grinder hub plate 56 are parallel to each other, and a series of shafts, such as shown at 58 and 60, extend between and interconnect chipper plate 54 and grinder hub plate 56.

A fan plate 60 is mounted to chipper plate 54 such as by rivets or the like, and a series of fan blades 62 are punched out of fan plate 60. Fan blades 62 each define an inner horizontal edge 64, an outer horizontal edge 66, a vertical side edge 68 and an angled side edge 70. Horizontal inner edge 64 is substantially shorter than horizontal outer edge 66. Upon rotation of rotor assembly 44 in response to operation of engine 16, a low-pressure area is generated by the fan blades 62 adjacent horizontal inner edge 64 and angled edge 70, and a high-pressure area is generated outwardly of horizontal outer edge 66.

Figure 5:
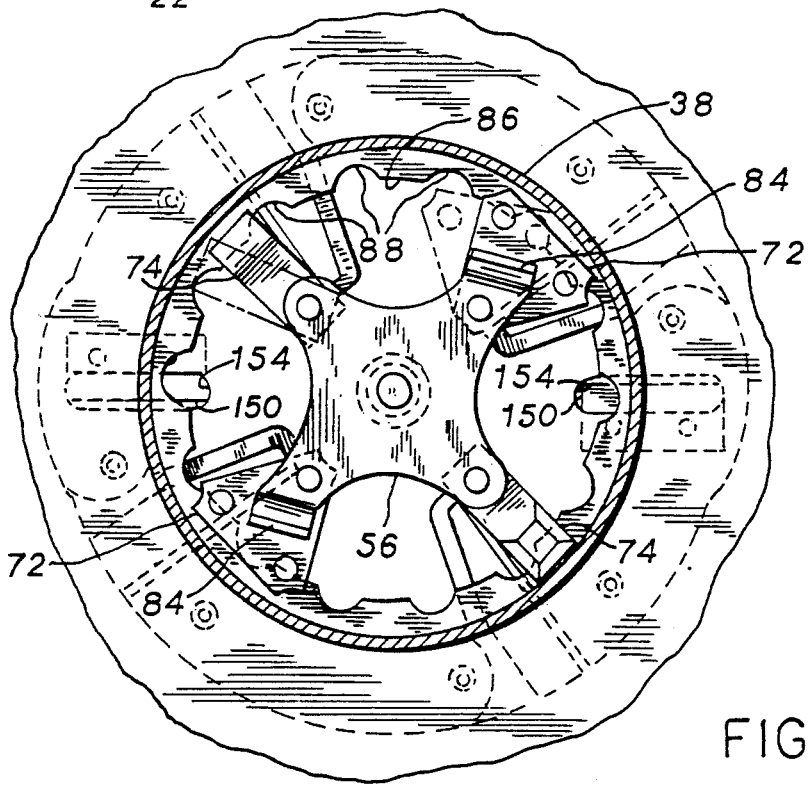
FIG. 5 is a partial vertical section view, taken along line 5—5 of FIG. 2.

Referring to FIGS. 2 and 5, a pair of triangular hammers 72 are mounted to a pair of the shafts, such as 58, extending between chipper plate 54 and grinder hub plate 56. Hammers 72 are constructed as shown and described in Baker U.S. Pat. No. 4,834,302 issued May 30, 1989, the disclosure of which is hereby incorporated by reference. Briefly, hammers 72 each define a pair of grinding points at each vertex of the triangular shape defined by the hammer, and a mounting opening is located adjacent each set of grinding points. Hammers 72 are mounted for free swinging or pivotable movement on the shafts, such as 58. Accordingly, hammers 72 pivot when the grinding points are unable to penetrate the material, to thus repetitively expose the material to the action of the grinding points upon rotation of rotor assembly 44. Hammers 72 can be removed and repositioned to a different mounting opening to expose a new set of grinding points when necessary.

Hammers 72 are located in close proximity to outer vertical wall 30 of fan housing 24, and are coplanar with each other.

In addition to hammers 72, a pair of J-shaped hammers 74 are mounted to the other set of shafts, such as 60, extending between chipper plate 54 and grinder hub plate 56. The J-shaped hammers 74 are oriented such that one of the hammers 74 has its bent outer end portion extending inwardly toward outer wall 30 of fan housing 24, and the other has its bent outer end portion extending outwardly toward vertical outer wall 36 of grinder housing 26. J-shaped hammers 72 are provided with sharpened edges along both sides of the bent outer end portion of each hammer. The J-shaped hammers 72 can thus be removed and switched to expose a sharp grinding edge when the other edge has become dulled.

A pair of socket head cap screws, shown generally at 76, are secured to horizontal wall 38 of grinder housing 26. Each of screws 76 defines a head 78 and a threaded shank 80, with a threaded nut 82 being threaded onto shank 80. Cap screws 76 are constructed of a hardened steel, and provide an inwardly extending projection extending into grinding chamber 40, to prevent material from simply sliding around the inside surface of horizontal wall 38 of grinder housing 26. That is, material catches on and is engaged by the heads 78 of cap screws 76 to provide resistance to flow of material on horizontal wall 38, allowing hammers 72 and 74 to engage the material to shred and grind it. The bent outer portions of J-shaped knives 74 provide clearance to prevent hammers 74 from contacting heads 78 of cap screws 76.

As stated, a pair of cap screws 76 are provided, and the cap screw 76 illustrated in FIG. 2 is shown out of position for purposes of illustration. Cap screws 76 are actually located at the 1:00 o'clock and 3:30 o'clock positions on circular horizontal wall 38 of grinder housing 26.

A pair of deflectors 84 are provided at the outer ends of the two arms of grinder hub plate 56 adjacent triangular hammers 72, between J-shaped hammers 74. Deflectors 84 define an outer surface which slants inwardly toward J-shaped hammers 74 and triangular hammers 72. Upon rotation of rotor assembly 44, deflectors 84 act to direct material toward hammers 72 and 74 to prevent the material from collecting adjacent the inner surface of outer grinder housing vertical wall 36, to prevent clogging and to ensure that the material is ground by hammers 72 and 74.

Referring to FIG. 5, a circular opening 86 is formed in outer vertical wall 30 of fan housing 24, and provides communication between fan chamber 34 and grinding chamber 40. A series of spaced scallops 88 are formed in vertical wall 30 outwardly of circular opening 86. The purpose and function of scallops 88 will later be explained.

Figure 4:
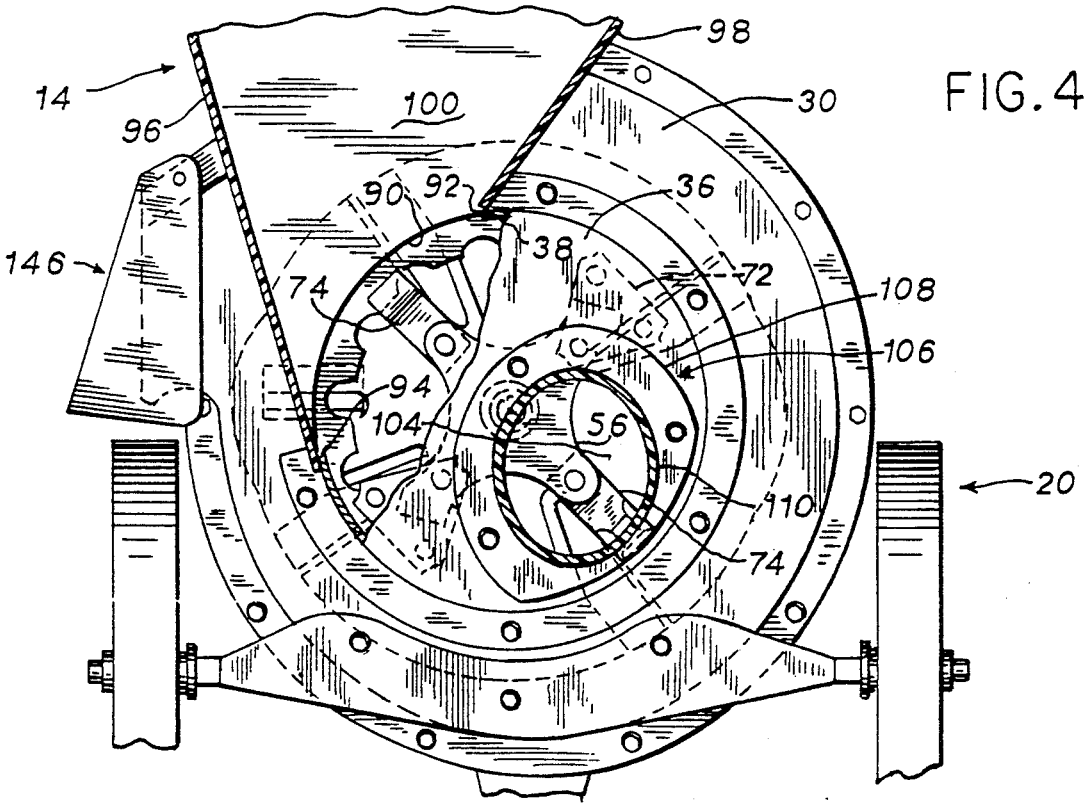
FIG. 4 is a partial front elevation view, with portions broken away, reference being made to line 4—4 of FIG. 2.

Referring to FIG. 4, a hopper inlet 90 is provided to grinder housing 26 between spaced ends 92 and 94 of grinder housing horizontal wall 38. Hopper 14 includes a pair of spaced walls 96 and 98 which converge toward each other in the direction of inlet 90, and which define a vertical passage 100 for supplying unprocessed material to inlet 90. As shown in FIG. 1, hopper 14 includes an internal cavity 102 in which the material is placed, and passage 100 receives such material from hopper cavity 102.

In addition, as also shown in FIG. 4, a hose inlet 104 is formed in vertical outer wall 36 of grinder housing 26. A connector assembly 106, which includes a flange 108 and a nipple 110, is mounted to grinder housing outer wall 36 over hose inlet 104. A plug, shown in FIG. 1 at 112, is normally placed in nipple 110 to close off hose inlet 104. Plug 112 is removable from nipple 110, and can be replaced with an adaptor 114 (FIGS. 6, 7) defining an internal passage 116 which communicates with hose inlet 104, and a hose 118 is engageable with adaptor 114. As shown in FIG. 7, adaptor 114 is provided with an end portion defining internal threads, and a conventional large-diameter hose, which includes a helically formed outer wall, is engageable with the internal threads provided at end portion 120. The reduced diameter inner end of adaptor 114, shown at 122, is engageable with nipple 110. A quick-disconnect system is provided on nipple 110, inner end 122 of adaptor 114, and plug 112, to provide quick and easy removal and replacement of plug 112 and adaptor 114.

A nozzle attachment, shown in FIG. 6 generally at 124, is mounted to the outer end of hose 118 in a manner similar to that described with respect to end portion 120 of adaptor 114, defining an internal passage 126 terminating in an end opening 128. A sleeve 130 is engageable with nozzle 124 over an opening 132 formed in nozzle 124, and sleeve 130 likewise includes an opening 134. Sleeve 130 is mounted for rotation to nozzle 124, to either establish or cut-off communication between sleeve opening 134 and nozzle opening 132 upon rotation of sleeve 130 on nozzle 124.

A leaf tray, shown in FIG. 6 at 136, can be engaged with the end of nozzle 124 to establish communication between nozzle passage 126 and an internal leaf-collecting cavity 138 defined by a series of walls associated with leaf tray 136.

Figure 3:
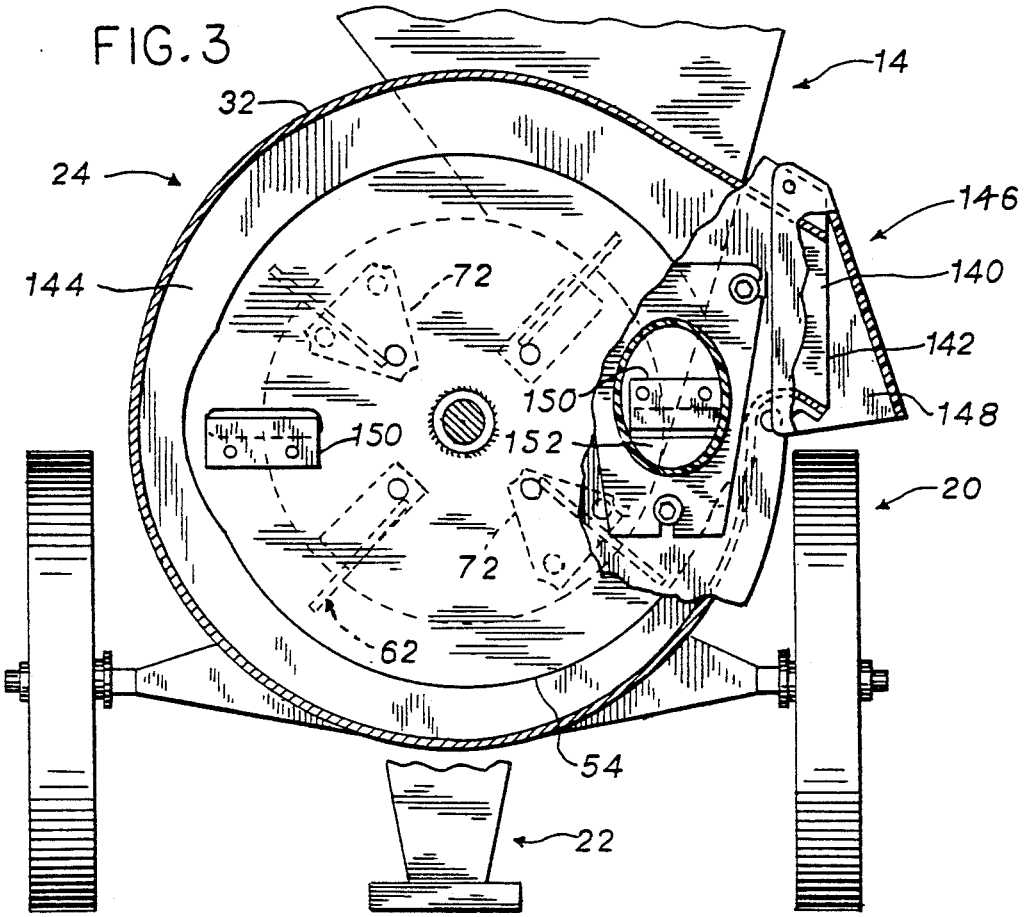
FIG. 3 is a partial section view taken along line 3—3 of FIG. 2.

Referring to FIG. 3, fan housing 34 terminates in an outlet passage 140 defining a vertical discharge opening 142. Horizontal wall 132 of fan housing 24 is non-circular relative to the circumcircle defined by fan blades 62 upon rotation of rotor assembly 44. In this manner, a scroll-shaped discharge passage, shown generally at 144, is defined outwardly of outer ends 66 of fan blades 62. At a point immediately clockwise relative to outlet passage 140, horizontal fan housing wall 32 is located in close proximity to the circumcircle defined by fan blade outer ends 66 upon rotation of rotor assembly 44. The dimension of discharge passage 144 gradually increases in a clockwise rotational direction, with the maximum dimension of passage 144 being located where passage 144 merges into outlet passage 140. The provision of a scroll-type discharge passage, such as 144, provides efficient conveying of the ground material located within passage 144 around fan chamber 34 for discharge through outlet passage 140 and outlet opening 142.

As also shown in FIG. 3, a deflector member 146 is pivotably mounted to fan housing 24 over discharge opening 142. Deflector member 146 defines a downwardly-opening deflector passage 148, for discharging material downwardly after its passage through discharge opening 142 of fan housing 24.

Referring to FIGS. 2 and 3, a pair of chipper knives 150 are mounted to the surface of chipper plate 54 which faces engine plate 28. Chipper knives 150 are spaced 180° apart, and each includes a sharpened outer edge. As shown in FIG. 3, a chipper opening 152 is formed in engine plate 28. Chipper chute 18 includes an internal passage in communication with chipper opening 152, to allow larger-sized branches to be inserted through the chipper chute passage into chipper opening 152 to be chipped by chipper knives 150 upon rotation of rotor assembly 44.

A slot 154 is formed in chipper plate 54 and extends through fan plate 60, to allow chips to pass therethrough from the sharpened outer ends of chipper knives 150.

Referring again to FIG. 1, a flexible sheet-like guard member 156 is connected to the rear wall 158 of hopper 14. Guard member 156 is constructed of a semi-rigid guard material slit at intervals along its length, to provide a fingered guard structure. Guard 156 is oriented at a downward angle relative to horizontal from its point of connection to hopper wall 158, and extends over passage 100 which communicates between hopper cavity 102 and grinder housing opening 90. That is, guard member 156 vertically overlaps passage 100, and prevents any material from being kicked back vertically out through grinder housing opening 90 upwardly out of hopper cavity 102.

Guard member 156 terminates in an outer end 160. Hopper 14 includes a curved front wall 162, the inner surface of which is similarly curved and which forms a portion of hopper cavity 102. A material flow passage is formed between outer end 160 of guard member 156 and the inner surface of hopper wall 162.

A hopper lid 164 is provided for selective placement on top of hopper 14, to selectively open or close access to hopper cavity 102. A handle 166 is formed integrally with hopper rear wall 158. Handle 166 can be grasped by a user to provide clockwise pivoting of processing apparatus 10 when it is desired to move apparatus 10 from one location to another by means of wheels 20.

In operation, processing apparatus 10 functions as follows. To process smaller yard waste such as twigs or leaves by placing such material into hopper 14, plug 112 is placed in nipple 110 so that material enters grinding chamber 40 only through grinding chamber hopper inlet 90. Hopper lid 164 is removed, and the material placed into hopper 164 is deflected by guard member 156 toward the inner surface of curved hopper front wall 162. Upon operation of engine 16, rotor assembly 44 is rotated so as to rotatably drive the fan mechanism disposed within fan chamber 34 and the grinding mechanism disposed within grinding chamber 40. Fan mechanism 62 generates a negative air pressure adjacent inner ends 64 and angled portions 70 of fan blades 62, which is communicated to grinding chamber 40 through circular opening 86 and scallops 88, and through hopper grinder housing inlet 90 to passage 100 and hopper cavity 102. This provision of negative air pressure to hopper cavity 102 draws the unprocessed material downwardly along the curved inner surface of hopper front wall 162, through passage 100 and into grinding chamber 40 through hopper inlet 90. The material is then subjected to the action of triangular hammers 72 and J-shaped hammers 74 to grind and shred the material. The material is retained within a grinding chamber 40 by vertical fan chamber wall 30. Once the material has been reduced by the action of hammers 72 and 74 to a sufficiently small size and/or weight, depending on the density of the material particles, the ground material is sucked through scallops 88 and into the low pressure area generated by fan blades 62. Once in fan chamber 34, the ground material is flung outwardly into fan chamber discharge passage 144, and is conveyed by the high air pressure provided outwardly of the outer ends 66 of fan blades 62 through passage 144 and to outlet passage 140 to outlet opening 142. The ground product is then deflected downwardly by deflector 146 for discharge, either onto the ground or into a bag secured to deflector 146 in which the ground material is collected.

Alternatively, lid 164 is placed on hopper 14 to close off external communication with hopper cavity 102, and plug 112 is removed from nipple 110. Adaptor 114 is then secured to nipple 110, and hose 118 to adaptor 22. If desired, leaf tray 136 can be mounted to nozzle 124 and placed on the ground, and leaves rakes directly into leaf tray 136. The negative air pressure provided in grinding chamber 40 is communicated through hose 118 to leaf tray 136, to suck leaves through hose 118 and into grinding chamber 40 through hose inlet 104. The material is then again subjected to the action of hammers 72 and 74, and discharged through fan housing 24 in the manner as described above.

Alternatively, nozzle 124 can be employed to gather material from areas which are hard to rake, such as under shrubs, behind bushes or the like. Where the full vacuuming power is unnecessary or undesirable, such as when leaves are on top of bark or the like, the leaves can be sucked through nozzle 124 by positioning sleeve opening 134 over nozzle opening 132 to reduce the vacuum experienced at nozzle end opening 128. In this manner, the light material, such as leaves, is collected while the heavier material, such as bark, remains in place.

To chip larger limbs or branches, having a diameter of approximately 2½ inches, the limbs or branches are inserted through chipper chute 18 and pushed into engagement with the surface of chipper plate 54 facing engine plate 28. Rotation of rotor assembly 44 thus causes chipper knives 154 to chip the branches or limbs. The chips formed by chipping of the branches or limbs pass through slots 154 and are flung outwardly by fan blades 62 for discharge through discharge passage 144 in the manner as described above.

Various alternatives and embodiments are contemplated as being within the scope of the following claims, particularly pointing out and distinctly claiming the subject matter regarded as the invention.

I claim:

1. An apparatus for processing material such as branches, twigs or leaves, comprising:

a grinder housing defining a grinding chamber and including an inlet through which unprocessed material is introduced into the grinding chamber;

a fan housing defining a fan chamber and located adjacent the grinder housing, the fan chamber including an outlet through which processed material is discharged, wherein the grinding chamber and the fan chamber are in communication with each other;

a rotatable grinding mechanism located within the grinding chamber, wherein unprocessed material introduced into the grinding chamber through the grinding chamber inlet is ground by the grinding mechanism upon rotation thereof;

a rotatable fan mechanism interconnected with the grinding mechanism and located within the fan chamber, wherein rotation of the fan mechanism within the fan chamber generates negative air pressure within the fan chamber to draw ground material from the grinding chamber into the fan chamber, wherein the fan mechanism and the grinding mechanism are arranged side-by-side on a rotor assembly rotatable about a rotor axis wherein a portion of the rotor assembly is located within the fan chamber and a portion of the rotor assembly is located within the grinding chamber, the rotor assembly comprising a pair of spaced parallel plate members with a plurality of shafts extending between and interconnecting the plate members, with a first one of the plate members being located within the fan chamber and a second one of the plate members being located within the grinding chamber, wherein the grinding mechanism comprises one or more hammers pivotably mounted to one or more of the shafts extending between the plate member; and wherein the rotatable fan mechanism and the fan chamber cooperate to define an arcuate discharge flow path to which ground material is supplied, at least a portion of the discharge flow path experiencing positive air pressure during rotation of the fan mechanism, and wherein the discharge flow path communicates with the fan housing outlet to discharge ground material therethrough.

2. The apparatus of claim 1, wherein the fan mechanism comprises a series of fan blades interconnected with the first plate member.

3. The apparatus of claim 1, wherein the grinder housing includes an outer wall, and further comprising one or more deflector members provided on the second plate member and located adjacent the grinder housing outer wall for directing material away from the outer wall and toward the grinding mechanism upon rotation of the grinding mechanism.

4. The apparatus of claim 1, wherein the first plate member comprises a chipper plate, and wherein the fan mechanism comprises a plurality of fan blades mounted to the chipper plate, and further comprising one or more chipper knives mounted to the chipper plate, and a chipper opening formed in the fan housing over which the chipper knives pass upon rotation of the fan mechanism, wherein branches are chopped by the chipper knives upon their insertion through the chipper opening and rotation of the fan mechanism, with the chipped branches being discharged from the fan chamber by rotation of the fan mechanism.

5. The apparatus of claim 4, further comprising a slot formed in the chipper plate for allowing chipped branches to pass therethrough after chipping by the chipper knife.

6. An apparatus for processing material such as branches, twigs or leaves, comprising:

a grinder housing defining a grinding chamber and including an inlet through which unprocessed material is introduced into the grinding chamber;

a fan housing defining a fan chamber and located adjacent the grinder housing, the fan chamber including an outlet through which processed material is discharged, wherein the grinding chamber and the fan chamber are in communication with each other;

a rotatable grinding mechanism located within the grinding chamber, wherein the grinding mechanism includes a rotor assembly to which one or more hammers are mounted, each hammer defining an outer end portion, and wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates negative air pressure within the fan chamber to draw ground material from the grinding chamber into the fan chamber; and wherein the grinder housing defines an arcuate wall facing the one or more hammers and wherein the outer end portions of the hammers are located in close proximity to the arcuate wall of the grinder housing, and further comprising one or more inwardly extending projections associated with the arcuate wall of the grinder housing each defining a leading surface which engages and retains the material to prevent material from sliding along the arcuate wall and to provide a surface against which the material is ground by the hammers.

7. The apparatus of claim 6, wherein the one or more inwardly extending projections are defined by the head portion of one or more threaded members secured to the arcuate wall of the grinder housing.

8. An apparatus for processing material such as branches, twigs or leaves, comprising:

a grinder housing defining a grinding chamber and including an inlet through which unprocessed material is introduced into the grinding chamber;

a fan housing defining a fan chamber and located adjacent the grinder housing, the fan chamber including an outlet through which processed material is discharged;

a wall disposed between the fan chamber and the grinding chamber, the wall having a substantially uninterrupted central opening providing communication between the grinding chamber and the fan chamber, the opening defining an inner peripheral edge;

a rotatable grinding mechanism located within the grinding chamber, wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates negative air pressure within the fan chamber to draw ground material from the grinding chamber into the fan chamber; and wherein the inner peripheral edge defined by the opening in the wall includes a series of spaced scallops for accommodating passage of material from the grinding chamber into the fan chamber.

9. The apparatus of claim 8, wherein the wall separating the fan chamber and the grinding chamber forms a portion of one of the fan housing or the grinder housing.

10. The apparatus of claim 8, wherein the fan mechanism comprises a plurality of fan blades rotatable about a fan axis, each blade defining an inner and an outer end, and wherein the fan housing includes an arcuate inner wall forming a portion of the fan chamber, and wherein the discharge flow path is disposed between the fan blade outer ends and the arcuate inner wall of the fan housing.

11. The apparatus of claim 10, wherein the fan blade outer ends define a circumcircle upon rotation of the fan mechanism, and wherein the arcuate inner wall of the fan chamber is arranged so as to be in close proximity to the circumcircle defined by the fan blade outer ends at a first location, with the distance between the circumcircle defined by the fan blade outer ends and the arcuate inner wall increasing in the direction of rotation of the fan mechanism toward the fan housing outlet, to assist in conveying ground material through the discharge flow path to the fan housing outlet.

12. The apparatus of claim 11, wherein each fan blade increases in height from its inner end toward its outer end to define a low pressure area at the fan blade inner ends upon rotation of the fan mechanism, and a high pressure area at the fan blade outer ends.

13. An apparatus for processing material such as branches, twigs or leaves, comprising:

a grinder housing defining a grinding chamber and including an inlet through which unprocessed material is introduced into the grinding chamber, the grinder housing including a vertical outer wall and one or more lateral side walls defining an inner arcuate wall, wherein the grinder housing inlet comprises an opening formed in the one or more lateral side walls of the grinder housing;

a hopper connected to the grinder housing and defining a passage for supplying material to the grinder housing inlet;

a fan housing defining a fan chamber and located adjacent the grinder housing, the fan chamber including an outlet through which processed material is discharged, wherein the grinding chamber and the fan chamber are in communication with each other;

a rotatable grinding mechanism located within the grinding chamber, wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates negative air pressure within the fan chamber to draw ground material from the grinding chamber into the fan chamber; and wherein the grinding mechanism and the fan mechanism are rotatable about a substantially horizontal axis of rotation.

14. The apparatus of claim 13, wherein the grinder housing further includes a second opening, formed in the vertical outer wall of the grinder housing, and further comprising a vacuum hose connected to the grinder housing by means of a connector assembly mounted over the second opening for receiving an end of the hose.

15. An apparatus for processing material such as branches, twigs, or leaves, comprising:

a grinder housing defining a grinding chamber and including an inlet through which unprocessed material is introduced into the grinding chamber;

a hopper disposed above the grinder housing and including at least first and second spaced walls which in part define a cavity for receiving unprocessed material, the hopper cavity communicating through a substantially vertical passage with he grinder housing inlet;

a fan housing defining a fan chamber and located adjacent the grinder housing, wherein the grinding chamber and the fan chamber are in communication with each other, a rotatable grinding mechanism located within the grinding chamber, wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates negative air pressure within the fan chamber to draw unprocessed material from the hopper cavity downwardly into the grinding chamber, and from the grinding chamber into the fan chamber; and a guard member connected to the first wall of the hopper and extending toward the second wall of the hopper, he guard member terminating in a distal end and being in vertical overlapping relationship with the passage through which the hopper cavity communicates with the grinder housing inlet, and wherein the second wall of the hopper defines a flow path around the distal end of the guard member leading to the passage.

16. The apparatus of claim 15, wherein the grinding mechanism and the fan mechanism are rotatable about a substantially horizontal axis of rotation, and wherein the inlet to the grinding chamber comprises an upwardly facing opening formed in the grinder housing.

17. The apparatus of claim 16, wherein the guard member comprises a sheet-like member constructed of a flexible material.

18. The apparatus of claim 17, wherein the second wall of the hopper includes a curved surface spaced from the distal end of the guard member.

19. The apparatus of claim 18, wherein the guard member slopes downwardly adjacent its distal end, and wherein material placed into the hopper is deflected by the guard member toward the curved surface of the second wall of the hopper and is drawn therealong by the negative air pressure generated within the fan chamber upon rotation of the fan mechanism, and into the passage through which the hopper cavity communicates with the grinder housing inlet.

20. An apparatus for processing material such as branches, twigs, or leaves, comprising:

a grinder housing defining a grinding chamber and including an inlet through which unprocessed material is introduced into the grinding chamber;

a hopper disposed above the grinder housing and defining a cavity for receiving unprocessed material, the hopper cavity communicating through a passage with the grinder housing inlet;

a fan housing defining a fan chamber and located adjacent the grinder housing, wherein the grinding chamber and the fan chamber are in communication with each other;

wherein the grinder housing and the fan housing comprise an assembly defining a pair of spaced vertical mounting surfaces;

a set of spaced wheels mounted to the grinder housing the fan housing assembly;

a rotatable grinding mechanism located within the grinding chamber, wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates negative air pressure within the fan chamber to draw unprocessed material from the hopper cavity downwardly into the grinding chamber, and from the grinding chamber into the fan chamber;

wherein the grinding mechanism and the fan mechanism are rotatable about a substantially horizontal axis of rotation and are driven by a power source having a horizontal output shaft; and wherein the hopper is mounted to one of the spaced vertical mounting surfaces and the power source is mounted to the other of the spaced vertical mounting surfaces and is solely supported thereby.

21. The apparatus of claim 20, further comprising a chipper assembly associated with one of the grinder mechanism or the fan mechanism, the chipper assembly including a chipper knife located adjacent a fist one of the vertical mounting surfaces, and further comprising a chipper chute mounted to the first vertical mounting surface defining an internal passage communicating with a chipper opening formed in the first vertical mounting surface.

22. An apparatus for processing material such as branches, twigs or leaves, comprising:

a grinder housing defining a grinding chamber and including an inlet through which unprocessed material is introduced into the grinding chamber;

a fan housing defining a fan chamber and located adjacent the grinder housing, the fan chamber including an outlet through which processed material id discharged, wherein the grinding chamber and the fan chamber are in communication with each other;

a rotatable grinding mechanism located within the grinding chamber, wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates negative air pressure within the fan chamber to draw ground material from the grinding chamber into the fan chamber;

wherein the grinding mechanism comprises a rotor assembly including a plurality of spaced shafts, with at least one hammer pivotably mounted to each shaft to thereby define a plurality of hammers associated with the grinding mechanism, and wherein the plurality of hammers define at least two distinct shapes.

23. The apparatus of claim 22, wherein one or more of the plurality of hammers comprise a first, planar hammers pivotably mounted to one or more of the shafts, and wherein one or more of the plurality of hammers comprise a second, non-planar hammer having a bent end portion pivotably mounted to one or more of the shafts.

24. The apparatus of claim 23, wherein the first, planar hammer has a substantially triangular shape and is mounted to one of the shafts adjacent one of its apices.

25. The apparatus of claim 23, wherein the second, non-planar hammer defines a first portion pivotably mounted to one of the shafts lying in a first plane, and a second portion bent in a first direction away from the plane of the first portion.

26. The apparatus of claim 25, further comprising a third, non-planar hammer mounted to one of the shafts defining a first portion pivotably mounted to one of the shafts lying in a first plane, and a second portion bent in a second direction, opposite said first direction, away from the plane of the first portion.

27. An apparatus for processing material such as branches, twigs or leaves, comprising:

a grinder housing defining a grinding chamber and including an outlet and an inlet through which unprocessed material is introduced into the grinder chamber;

a fan housing defining a fan chamber and located adjacent the grinder housing, the fan chamber including an inlet adjacent the grinding chamber outlet, and an outlet through which processed material is discharged;

a rotatable grinding mechanism located within the grinding chamber, wherein unprocessed material introduced into the grinding chamber through the grinding chamber inlet is ground by the grinding mechanism upon rotation thereof;

a rotatable fan mechanism located within the fan chamber, wherein rotation of the fan mechanism within the fan chamber generates a negative air pressure within the fan chamber; and a peripheral partial wall disposed between the grinding chamber outlet and the fan chamber inlet and in part defining the grinding chamber, the partial wall including an inner peripheral edge defining a substantially uninterrupted central opening through which ground material is drawn from the grinding chamber into the fan chamber.

28. The apparatus of claim 27, further comprising a series of spaced outward scallops formed in the inner peripheral edge of the partial wall, through which ground material passes from the grinding chamber into the fan chamber.

* * * * *

UNITED STATES PATENT AND TRADEMARK OFFICE

CERTIFICATE OF CORRECTION

PATENT NO. : 5,156,345

DATED : October 20, 1992

INVENTOR(S) : Herbert R. Baker

It is certified that error appears in the above-identified patent and that said Letters Patent is hereby corrected as shown below:

| | |
|---|---|
| Column 3, Line 12, | after "an" insert -- outer end of the guard member to provide flow of unprocessed --; |
| Column 9, Line 5, | after "axis" insert -- , --; |
| Column 9, Line 44, | cancel "chopped" and insert -- chipped --; |
| Column 11, Line 63, | cancel "he" and insert -- the --; |
| Column 12, Line 15, | cancel "he" and insert -- the --; |
| Column 12, Line 59, | cancel "the" and insert -- and --; |
| Column 13, Line 15, | cancel "fist" and insert -- first --; |
| Column 13, Line 29, | cancel "id" and insert -- is --; |
| Column 13, Line 52, | cancel "hammers" and insert -- hammer --; |

UNITED STATES PATENT AND TRADEMARK OFFICE

CERTIFICATE OF CORRECTION

PATENT NO. : 5,156,345

DATED : October 20, 1992

INVENTOR(S) : Herbert R. Baker

It is certified that error appears in the above-indentified patent and that said Letters Patent is hereby corrected as shown below:

Column 14, line 24, cancel "grinder" and insert --grinding--

Signed and Sealed this

Seventh Day of December, 1993

Bruce Lehman

*Attest:*

BRUCE LEHMAN

*Attesting Officer*

*Commissioner of Patents and Trademarks*